US010563603B2

(12) United States Patent
Froehlich et al.

(10) Patent No.: US 10,563,603 B2
(45) Date of Patent: Feb. 18, 2020

(54) METHOD FOR CONTROLLING AN INTERNAL COMBUSTION ENGINE

(71) Applicant: INNIO Jenbacher GmbH & Co OG, Jenbach (AT)

(72) Inventors: Moritz Froehlich, Kramsach (AT); Herbert Kopecek, Schwaz (AT); Herbert Schaumberger, Muenster (AT); Nikolaus Spyra, Innsbruck (AT)

(73) Assignee: INNIO JENBACHER GMBH & CO OG, Jenbach (AT)

( * ) Notice: Subject to any disclaimer, the term of this patent is extended or adjusted under 35 U.S.C. 154(b) by 4 days.

(21) Appl. No.: 14/921,462

(22) Filed: Oct. 23, 2015

(65) Prior Publication Data

US 2016/0146132 A1 May 26, 2016

(30) Foreign Application Priority Data

Nov. 24, 2014 (AT) ..... A 845/2014

(51) Int. Cl.
*F02D 41/34* (2006.01)
*F02D 41/00* (2006.01)

(52) U.S. Cl.
CPC ..... *F02D 41/009* (2013.01); *F02D 41/008* (2013.01)

(58) Field of Classification Search
CPC .. F02D 2250/28; F02D 41/008; F02D 41/009; F02D 41/1498
See application file for complete search history.

(56) References Cited

U.S. PATENT DOCUMENTS 4,656,993 A 4/1987 Yuzawa et al.
4,766,865 A * 8/1988 Hartel ..... F02D 41/009 123/476

(Continued)

FOREIGN PATENT DOCUMENTS

DE 195 25 240 1/1996
DE 694 10 911 10/1998

(Continued)

OTHER PUBLICATIONS

Unofficial English translation of Japanese Office Action issued in connection with corresponding JP Application No. 2015225463 dated Aug. 17, 2016.

(Continued)

*Primary Examiner* — George C Jin
*Assistant Examiner* — Teuta B Holbrook
(74) *Attorney, Agent, or Firm* — Fletcher Yoder, P.C.

(57) ABSTRACT

A method of controlling an internal combustion engine having a plurality of cylinders, in particular a stationary internal combustion engine, wherein actuators of the internal combustion engine are actuable in crank angle-dependent relationship and/or sensor signals of the internal combustion engine can be ascertained in crank angle-dependent relationship, for compensation of a torsion of a crankshaft, by which torsion deviations in the crank angle occur between a twisted and an untwisted condition of the crankshaft, wherein for at least two of the cylinders a cylinder-individual value of the angle deviation is ascertained and the crank angle-dependent actuator or sensor signals are corrected in dependence on the detected angle deviation.

13 Claims, 3 Drawing Sheets

(56) References Cited

Figure 1B:
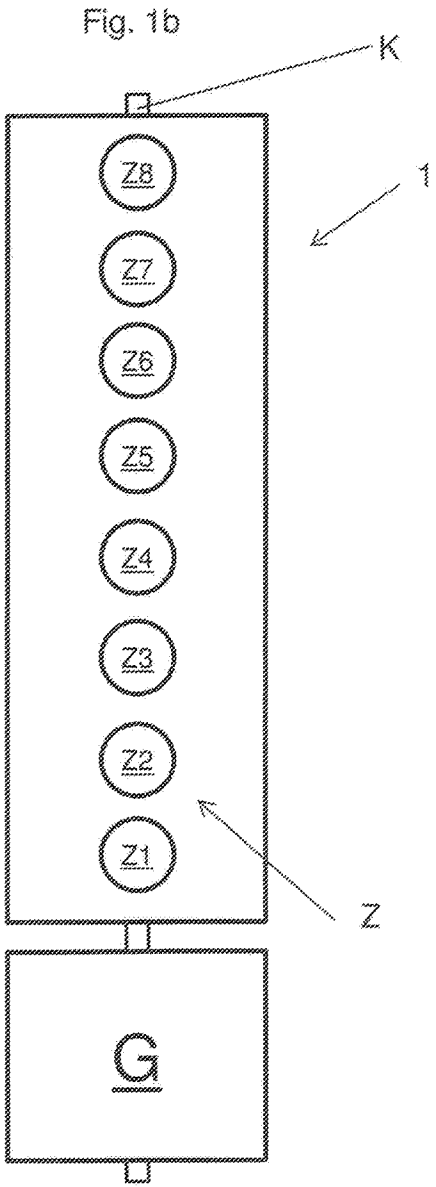

U.S. PATENT DOCUMENTS 5,086,741 A * 2/1992 Nakamura ..... F02D 41/045 123/406.2
5,157,965 A * 10/1992 Koegeler ..... F02B 75/16 73/114.15
5,182,943 A * 2/1993 Fukui ..... F02D 41/009 73/114.27
5,377,537 A 1/1995 James
5,447,061 A * 9/1995 Fujiki ..... G01M 15/11 701/110
5,493,901 A * 2/1996 Kuroda ..... G01M 15/11 123/406.24
5,548,995 A * 8/1996 Clinton ..... F01L 1/34 701/99
5,600,056 A * 2/1997 Hasegawa ..... F02D 41/008 73/114.72
5,611,311 A 3/1997 Tomisawa
6,341,253 B1 * 1/2002 Honda ..... F02D 41/009 123/406.62
6,854,455 B2 * 2/2005 Lingener ..... F02D 41/009 123/406.6
2003/0140895 A1 * 7/2003 Nicolaou ..... F02P 5/1522 123/406.21
2003/0230205 A1 * 12/2003 Mutschler ..... B41F 13/0045 101/216
2004/0168662 A1 * 9/2004 Wintner ..... G02B 5/1876 123/143 B
2004/0177837 A1 * 9/2004 Bryant ..... F02B 29/0418 123/559.1
2004/0236496 A1 * 11/2004 Sobel ..... F02D 35/0007 701/114
2005/0205063 A1 * 9/2005 Kolmanovsky ..... F01L 9/04 123/436
2006/0089784 A1 4/2006 Spicer et al.
2006/0142926 A1 * 6/2006 Yasui ..... F02D 41/1497 701/111
2007/0000461 A1 * 1/2007 Schon ..... F01L 13/0063 123/90.17
2007/0137284 A1 * 6/2007 Kluth ..... F02D 35/027 73/35.03
2007/0163547 A1 * 7/2007 Nakasaka ..... F02D 13/0207 123/478
2009/0064967 A1 * 3/2009 Shikawa ..... F02D 13/0226 123/345
2009/0182480 A1 * 7/2009 Delp ..... F02D 13/0223 701/102
2009/0183559 A1 * 7/2009 Birk ..... F02D 41/009 73/114.27
2009/0211554 A1 * 8/2009 Tabata ..... F02B 29/083 123/435
2011/0023826 A1 * 2/2011 Portin ..... F02D 35/023 123/435
2011/0290215 A1 * 12/2011 Boewing ..... F02D 35/025 123/406.55
2012/0160022 A1 * 6/2012 Kimura ..... F02B 75/041 73/114.72
2012/0232774 A1 * 9/2012 Minatoya ..... F02D 41/1498 701/105
2013/0338906 A1 * 12/2013 Akazaki ..... F02D 41/3005 701/105
2014/0053811 A1 * 2/2014 De Ojeda ..... F02D 41/00 123/435
2015/0159618 A1 * 6/2015 Nakasaka ..... F02P 5/152 123/406.33
2015/0198136 A1 * 7/2015 Martin ..... F02D 41/009 356/72
2015/0292466 A1 * 10/2015 Oyama ..... H04L 1/08 123/179.3
2015/0315993 A1 * 11/2015 Nagai ..... F02D 35/023 701/102
2016/0032852 A1 * 2/2016 Garrard ..... F02D 41/123 123/435
2016/0333781 A1 * 11/2016 Sakayanagi ..... F02D 35/028

FOREIGN PATENT DOCUMENTS

DE 197 22 316 12/1998
DE 11 2005 002 642 9/2007
DE 10 2007 019279 11/2008
JP H02-157457 A 6/1990
JP 11-51816 2/1999
JP 2001-3793 1/2001
JP 2001-003793 A 1/2001
JP 2001003793 A * 1/2001
JP 2009503478 A 1/2009
JP 2009121407 A * 6/2009
JP 2009121407 A 6/2009

OTHER PUBLICATIONS

Austrian Search Report dated Mar. 12, 2015 in corresponding Austrian Patent Application No. 845/2014 (with English translation).
Extended European Search Report dated Apr. 29, 2016, in corresponding European Patent Application No. 15 00 3113.
Korean Office Action issued in connection with corresponding KR Application No. 10-2015-0164148 dated Mar. 2, 2017.
Office Action issued in connection with corresponding EP Application No. 15003113.6 dated Aug. 17, 2018 (English translation not available).

* cited by examiner

METHOD FOR CONTROLLING AN INTERNAL COMBUSTION ENGINE

The invention concerns a method of controlling an internal combustion engine having the features of the classifying portion of claim 1 and an internal combustion engine having the features of the classifying portion of claim 11.

It is known that, due to torsional twisting of the crankshaft of internal combustion engines, crank angle-dependent signals such as for example control times for ignition, fuel injection or the like are affected by an error which adversely affects the power output and/or the efficiency of the internal combustion engine. Therefore the state of the art already has proposals for compensating for or taking account of the deviations, caused by torsion of the crankshaft, from the desired control times. Thus for example DE 19 722 316 discloses a method of controlling an internal combustion engine, wherein, starting from a signal which characterises a preferred position of a shaft (top dead center of the cylinder), control parameters are predetermined, wherein cylinder-individual corrections for that signal are provided. In that case those corrections are stored in a performance map of correction values. In that arrangement the control parameters may involve the injection of fuel, in particular the injection time. By virtue of torsional fluctuations in the crankshaft and/or the camshaft there is a deviation between the position of the reference pulse R and the actual top dead center point of the crankshaft. In accordance with that specification it is provided that correction values are ascertained, stored in a memory and taken into consideration when calculating the actuation signals. In that case those correction values are stored in a memory in dependence on operating conditions for each cylinder.

DE 69 410 911 describes an apparatus for and a method of compensating for torsional disturbances in respect of the crankshafts. The method described therein involves the detection of misfires in internal combustion engines and a system for compensating for systematic irregularities in the measured engine speed, which are triggered by torsion-induced bending of the crankshaft. For that purpose use is made of cylinder-individual correction factors, which are produced offline and stored in a memory device, for ignition pulses, to compensate for irregularities in the synchronisation of profile ignition measurement intervals. In that case that performance map of correction factors is determined upon calibration of an engine type by a test engine or by a simulation.

DE 112 005 002 642 describes an engine management system based on a rotary position sensor. In that case the engine management system includes two angle position sensors for a rotating engine component to determine the torsional deflection of the component. In that case the engine management device reacts to torsional deflections by changing the operation of the engine. It is provided in that case that the crankshaft has a respective sensor at the front and at the rear end of the crankshaft in order to determine the angle positions of the front and rear ends relative to each other.

A disadvantage with the solutions known from the state of the art is that only local twisting is determined or calculated in relation to individual cylinders or overall twisting of the crankshaft is determined or calculated in relation to the crankshaft angle.

A further disadvantage of the solutions known from the state of the art is also that the crankshaft angle information is ascertained only for a single selected crankshaft angle position, mostly at the top or bottom dead center point. That is advantageous in particular because not all sensor events and/or actuator events have to be indispensably correlated with the top dead center.

Therefore the object of the invention is to provide a method and an internal combustion engine by which the crank angle deviation is determined for individual or all cylinders in cylinder-individual and crank angle-resolved relationship and therewith a corresponding crank angle-dependent sensor signal and/or crank angle-dependent actuator signal can be corrected.

That object is attained by a method as set forth in claim 1 and an internal combustion engine as set forth in claim 11. Advantageous configurations are defined in the appendant claims.

With the method according to the invention that is achieved in that for at least two of the cylinders a cylinder-individual value of the angle deviation is ascertained and the crank angle-dependent actuator or sensor signals are corrected in dependence on the detected angle deviation.

In other words this means that a cylinder-individual crank angle-resolved value in respect of the angle deviation is assigned to at least two of the cylinders and crank angle-dependent sensor signals and/or crank angle-dependent actuator signals are corrected in dependence on the angle deviation.

Cylinder-individual ascertainment of the crank angle position means that the crank angle position is or can be determined in relation to any position of the crankshaft, with which a cylinder is associated.

Crank angle-resolved means that the crank angle information is present not just, as described in the state of the art, for a single selected crankshaft angle position but for each crank angle of a working cycle (720° in the case of a four-stroke engine).

The cylinder-individual value therefore specifies for an individual cylinder of the plurality of cylinders that angle deviation in degrees, which the cylinder in question has in relation to its angle position in the case of an unloaded crankshaft which is therefore not influenced by torsion.

It has been found more specifically in the applicants' tests and calculations that the torsion-induced angle deviation of individual cylinders does not correspond to the angle deviation interpolated from an overall torsional twisting. Rather, marked deviations occur in relation to that idealised view, which on the one hand are caused by additional torsional fluctuations superimposed on the torsion. That for example can have the result that the angle deviation is of a different sign in relation to the value calculated by means of interpolation of the overall twist, that is to say the expected moment in time of passing through the corresponding crankshaft position can also occur later instead of earlier or also vice-versa.

The particular advantage of the method according to the invention is also that the information about the actual crank angle is present not only on a cylinder-individual basis, that is to say for each cylinder position along the longitudinal axis of the crankshaft, but also in crankshaft angle-resolved relationship. That is a particularly attractive proposition for the reason that not all sensor events and/or actuator events have to be indispensably correlated with the top dead center. Examples of crank angle-dependent interventions which do not take place at the top dead center are for example ignition, injection, pre-injection and also the evaluation of crank angle-based characteristics like cylinder pressure. It is therefore relevant to also know the real crank angle displacement for a different angle position of the crankshaft than the top dead center point.

According to a further preferred embodiment it is provided that the cylinder-individual value of the angle deviation is measured. That example concerns the situation in which the value of the angle measurement is measured directly for at least one cylinder of the plurality of cylinders. That can be implemented for example in such a way that provided at the position of the crankshaft, associated with the cylinder in question, is a measuring device which supplies a signal characteristic of the deformation of the crankshaft.

A particularly preferred case is that in which deformation of the crankshaft is measured at positions near the end of the crankshaft. A position near the end means that, in relation to the longitudinal axis of the crankshaft, one measuring position is before the first cylinder and a second measuring position is after the last cylinder. The reference to 'first' and 'last' cylinders relates to the usual numbering of cylinders of an internal combustion engine.

Measurement at the positions near the ends of the crankshaft serves for calibration of the values, ascertained by calculation, of the angle deviations.

In a further preferred embodiment it can be provided that the cylinder-individual value of the angle deviation is calculated.

Here it is therefore provided that the value of the angle deviation is ascertained by way of computation methods for at least one of the n cylinders. A possible option in that respect is analytical solutions for deformation of the crankshaft in dependence on the currently prevailing operating conditions like for example produced power and/or torque.

In accordance with an embodiment a substitute function is formed, which, starting from present input values, outputs the torsion of the crankshaft of all support points present in respect of the propagating torsional fluctuation over the engine cycle.

In accordance with this example the following parameters are used as input parameters of the substitute function in respect of crankshaft torsion:

firing order firing spacing distance between cylinder position relative to the measurement position at the crankshaft material properties and geometry of the crankshaft maximum amplitude of the torsion at a defined load point (ascertained either from model calculation of the deformation of the crankshaft with a given torque or from reference measurement at the opposite end of the crankshaft)

engine load (for scaling of the amplitude in operation).

A cylinder-individual weighting factor is firstly determined in the calculation for all cylinders. That weighting factor takes account of the firing spacings of successively firing cylinders. The firing spacing is the angular difference in the firing time of two successively firing cylinders.

In accordance therewith a torsion characteristic can be determined for each cylinder. The torsion characteristic arises out of multiplication of the firing spacing relative to the previous cylinder (in accordance with the firing order) by the distance relative to the reference point of the shaft and the weighting factor.

The torsion characteristic is scaled over the maximum amplitude of the torsion. That means that the magnitude of the calculated torsion characteristic is calibrated with the magnitude, ascertained by measurement, of the torsion for a selected position. Desirably calibration is effected with the maximum torsion value.

The torsion characteristic can now be scaled by taking account of the engine load for various load points.

Subsequently a weighting factor in respect of the support points is defined on the basis of the ratio of the firing spacings of successively firing cylinders. On the basis of the angular spacing between two successively firing cylinders, the distance relative to the reference point of the shaft and the calculated weighting factor of the support points, a torsion characteristic is calculated for each cylinder. That characteristic is scaled with the measured, modelled or calculated maximum amplitude of the torsion.

The cylinder next in the firing order is now selected. That cylinder receives an allotted factor which is proportional to the geometrical spacing, that is to say the distance of the corresponding crank throws of the crankshaft of that cylinder relative to the starting cylinder. That factor is representative of the extent of twist relative to a reference point, for example the gear ring, at which a twist can be easily measured, for the twist of two cylinders relative to each other at the same torsional moment is correspondingly greater, the further apart that the two cylinders are disposed.

In the next step the cylinder next in the firing order is again selected and the geometrical spacing relative to the last-fired cylinder is used as the factor.

That factor is ascertained in the same manner for all remaining cylinders. Then, the magnitude of the factor is calibrated with the second measured value at the crankshaft in such a way that, at that second measurement position, by applying the multiplication factor, the correct value for the angle deviation is afforded. Explained in other words, the angle deviation for the last cylinder must be afforded by multiplication of the angle deviation of the first cylinder by the factor of the last cylinder. Now, the multiplication factors of all cylinders can be calibrated by way of the relationship, accessible by measurement, between those two positions.

The action of the substitute function will now be described by means of an example:

The firing order is a time succession of the ignition times of the individual cylinders, that is predetermined by the crank throws of the crankshaft, that is to say mechanically and for an engine being considered.

If now that factor is applied for all cylinders in accordance with the firing order the angle deviation caused by the torsion is seen for each cylinder.

An amplitude value (magnitude of the twist), with which the calculation result can be scaled, is ascertained for the substitute function, for at least one cylinder. The magnitude of the twist is a measure in respect of the elastic characteristic values and the stiffness of the crankshaft.

The magnitude is correspondingly greater, the further away that its predecessor is disposed.

To correctly reproduce the torsion characteristics of the crankshaft the firing order and firing spacings are next taken into consideration. In the case of a V-engine the firing spacings can be for example at 60° and 30° crank angles so that all cylinders are distributed over a working cycle of 720° crank angle. The firing spacing is a measure in respect of the irregularity with which torsion or torsion fluctuations are introduced into the crankshaft.

In the next step the cylinder following the reference cylinder is considered: the magnitude thereof in relation to twisting is determined by multiplication of the value ascertained for the reference cylinder, by the geometrical longitudinal spacing.

It can preferably be provided that the cylinder-individual value of the angle deviation $\Delta\varphi_i$ is calculated by a model function. That involves the situation where a model function is produced for the deformations of the crankshaft, from which the value $\Delta\varphi_i$ of the angle deviation can be ascertained for the crankshaft position associated with the cylinder i. The model function involves on the one hand the geometrical and elastic parameters of the crankshaft, and on the other hand also the currently prevailing operating conditions like for example the produced power and/or the torque. The model function which contains all relevant geometrical and elastic parameters of the crankshaft can now be easily calibrated by way of the previously ascertained correction function. As a boundary condition, for a zero load the twist must also be zero.

In a preferred development it is provided that the cylinder-individual value $\Delta\varphi_i$ of the angle deviation is calculated in real time based on engine output signals. This therefore involves the situation where calculation of the angle deviation takes place in real time, that is to say recourse is not made to a predetermined solution for the angle deviation, but the calculation is effected instantaneously, that is to say directly, in the current engine cycle. The particular advantage of this embodiment is that rapidly variable parameters, for example a fluctuating engine load, can be taken into consideration in the evaluation process.

It can preferably be provided that at least one engine management parameter is varied in dependence on at least one cylinder-individual value of the angle deviation $\Delta\varphi_i$. That describes the situation where at least one engine management parameter involves the ascertained angle deviation $\Delta\varphi_i$ as a further input parameter and thus the angle deviation of the at least one cylinder can be compensated. The engine management parameter can be for example the ignition time or the injection time of a fuel or the opening time of a fuel introduction device. Thus for example when ascertaining a positive angle deviation $\Delta\varphi_i$ for a cylinder Z i (in other words the cylinder Z followed by the index i reaches its position earlier than intended), the ignition time for that cylinder can be advanced.

In a further preferred embodiment it is provided that at least one engine measurement signal is corrected by way of at least one cylinder-individual value of the angle deviation $\Delta\varphi_i$. This means that measurement signals from the engine, for example the signals of cylinder pressure detection, are corrected by means of the ascertained value of the angle deviation $\Delta\varphi_i$. Corrected means that, by taking account of the angle deviation, the measurement signals can be substantially more accurately associated with the actual position of the piston of the piston-cylinder unit being considered. That is an attractive proposition in particular for cylinder pressure detection for the crank angle in fact determines the spatial position of the piston in the cylinder. In the case of an angle deviation therefore the detected cylinder pressure is associated with an incorrect spatial position of the piston. Therefore correction is particularly advantageous for engine diagnostics generally as now sensor signals can always be associated with the correct crankshaft position.

Figure 1A:
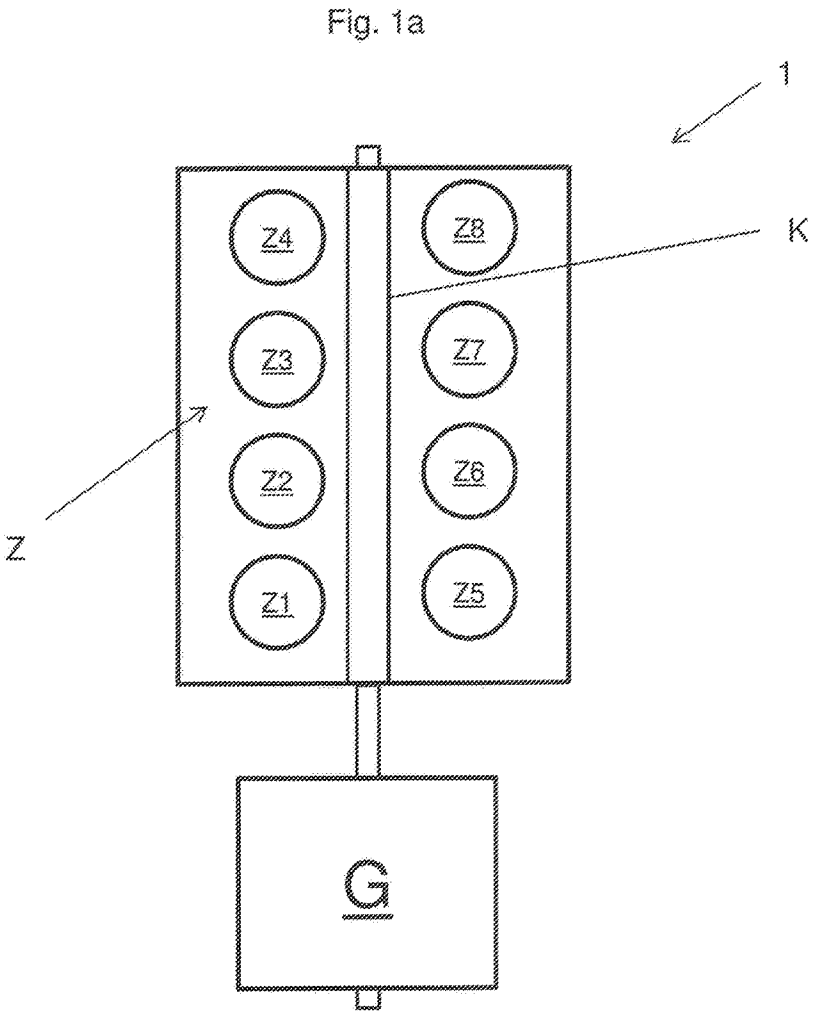
Figure 2:
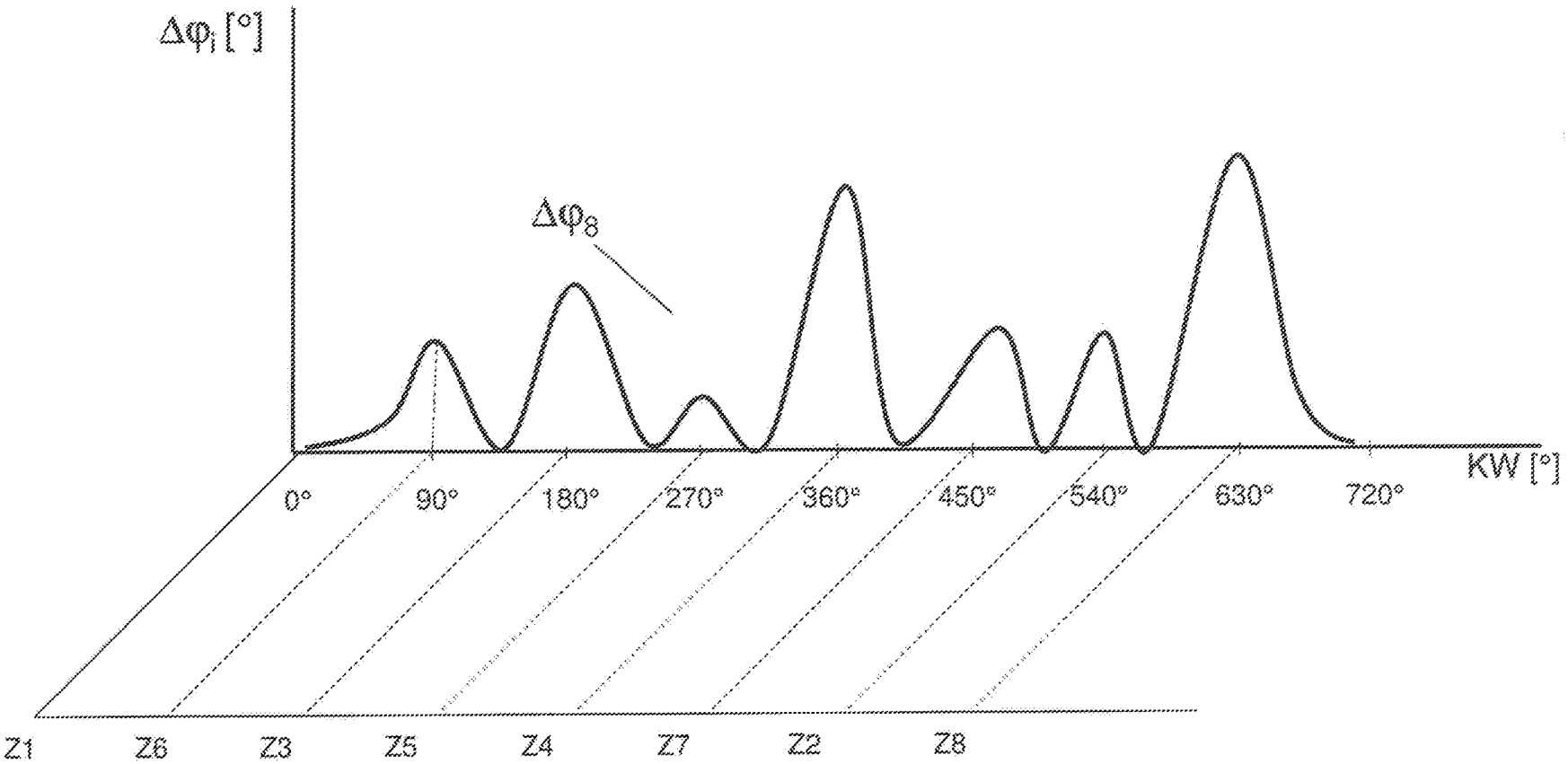
Figure 3:
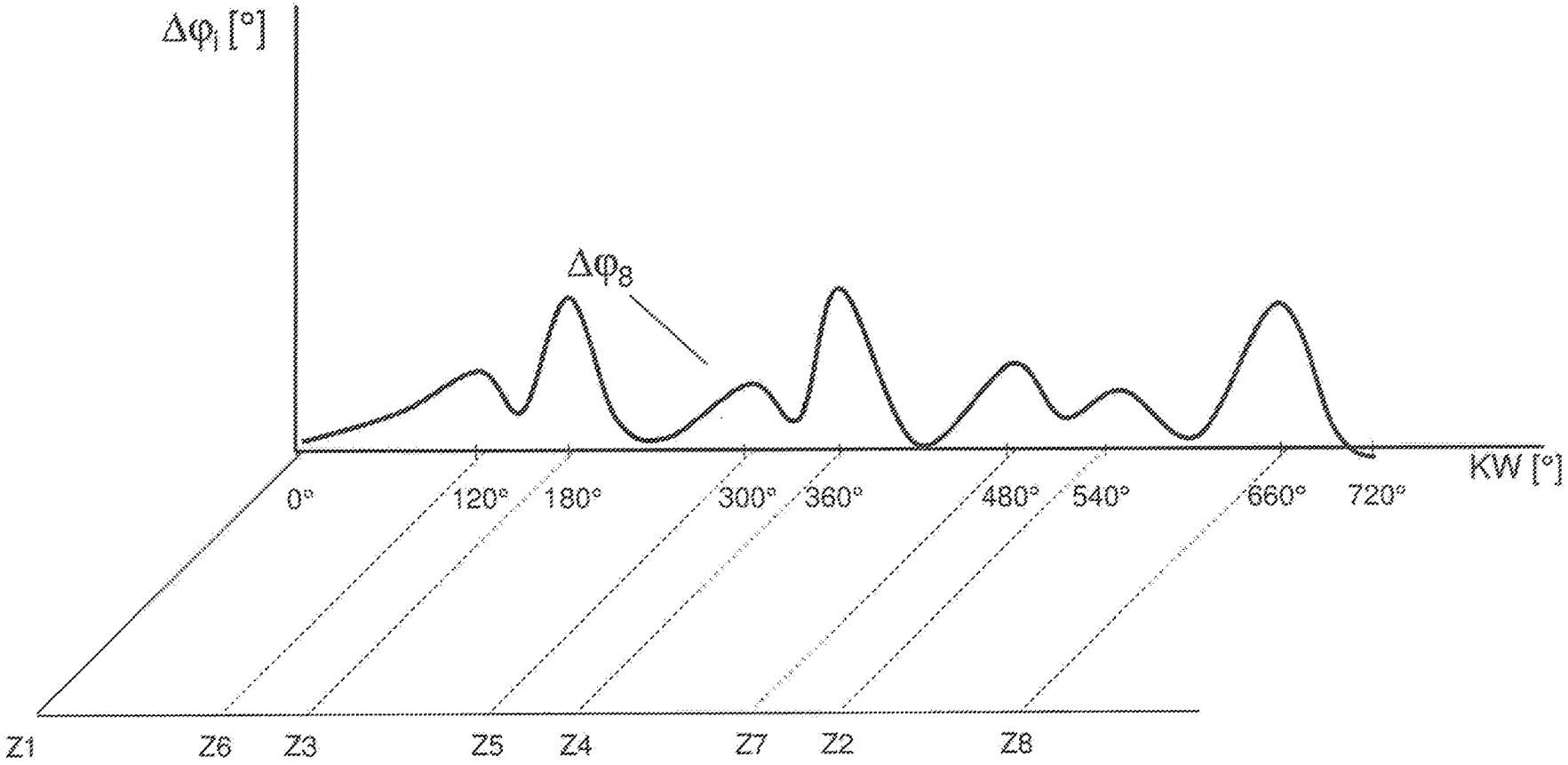

The advantages of the invention are described more fully hereinafter with reference to the drawings in which:

FIGS. 1*a* and 1*b* show a diagrammatic view of an internal combustion engine, FIG. 2 shows a view of the torsion-induced crankshaft angle deviation for a 90° firing spacing, and FIG. 3 shows a view of the torsion-induced crankshaft angle deviation for a 120/60° firing spacing.

The detailed specific description now follows.

FIG. 1*a* diagrammatically shows an internal combustion engine having eight cylinders, wherein counting will be begun at the drive output side (in this case marked by the generator G) on the left-hand cylinder bank. In the case of the V-engine cylinders Z1-Z4 are on the left-hand cylinder bank and cylinders Z5-Z8 are on the right-hand cylinder bank.

The Figure also indicates the crankshaft K to which the cylinders Z1 through Z8 are connected by connecting rods. The cylinder Z1, that is to say the location at which force is introduced by the connecting rod of cylinder Z1, is quite close to the drive output side which is assumed to be fixed.

FIG. 1*b* shows an internal combustion engine with eight cylinders in an in-line arrangement. In the in-line engine the cylinders are counted from Z1 through Z8.

In these examples let the firing order be Z1→Z6→Z3→Z5→Z4→Z7→Z2→Z8.

In FIG. 1*b* the firing spacing, expressed as the crank angle difference, is 90°. After ignition in the cylinder Z8 the process begins again with cylinder Z1. For this example the firing spacing is therefore distributed in relation to the crank angle at equal spacings to the cylinders. A firing event takes place every 90° crank angle.

FIG. 2 shows a graph in which the torsion-induced angle deviation of the crankshaft is plotted on the ordinate at the position of cylinder Z8, $\Delta\varphi_8$, over an entire working cycle, that is to say 720° crank angle.

When now the above-discussed firing order is implemented, that gives the illustrated angle deviation $\Delta\varphi_8$ which is discussed hereinafter. For better understanding, those cylinders which fire at the respective crankshaft position have been plotted in a parallel-shifted auxiliary axis.

Firstly cylinder Z1 fires at 0° crank angle. As cylinder Z1 is quite close to the drive output side which is assumed to be rigid the firing event of cylinder Z1 can cause as good as no twisting of the crankshaft with respect to the crankshaft position of cylinder Z8.

The next firing event, 90° crankshaft angle later, occurs at the cylinder Z6. By virtue of the distance relative to the drive output side that causes the greater contribution to twisting of the crankshaft.

Expressed in words, the peak of the curve $\Delta\varphi_6$ corresponds at the crankshaft position 90° to the contribution of the crankshaft angle deviation caused by the cylinder Z6, at the position of the cylinder Z6.

The next firing event, this is cylinder Z3, occurs at the 180° crankshaft angle. That cylinder (more precisely: the engagement point of the associated connecting rod with the crankshaft) is less far away from the drive output side than Z8 and can thus cause only a lesser contribution to the twist of the crankshaft at the position of cylinder Z8. The next firing event (cylinder Z5) occurs at the 270° crankshaft angle and, because of the even closer position to the drive output, produces a markedly lesser contribution to the twist at the crankshaft position of cylinder Z8 than for example the cylinders Z8 and Z3. Next the cylinder Z4 fires and causes a greater twist (comparable to the cylinder Z8) as it is similarly far away from the drive output as the cylinder Z8. The next firing event is the firing of cylinder Z7 at the 450° crankshaft angle. The subsequent firing event is the cylinder Z2 at 540° and Z8 at 630°. The 720° again correspond to the beginning of the scale at 0°, that is to say firing of cylinder Z1.

If torsion-induced angle deviation for other cylinders is incorporated into the graph then the maxima are below the curve plotted for cylinder Z8, scaled by their respective spacing from the drive output side assumed to be rigidly fixed.

It will be seen therefore that the cylinders make quite different contributions to the twist of the crankshaft at the cylinder position Z8, due to their different spacing from the drive output side. The resulting curve therefore describes the torsion-induced crankshaft twist, in crankshaft angle-resolved and cylinder-individual relationship (shown here for the crankshaft position of cylinder Z8). That characteristic of the angle deviation $\Delta\varphi_i$ (with i as the numerator of the respective cylinder) can now be extrapolated to any desired cylinder or to any desired axial position of the crankshaft as, as a further boundary condition, the angle deviation caused by torsion is known for the cylinder Z1 as 'zero'.

The equidistant choice of the firing spacings (every 90°) affords the same spacing in respect of time in regard to the propagation of a torsional fluctuation for all cylinders, which means: the torsional fluctuation has to be propagated for all cylinders the same time. The level of the angle deviation $\Delta\varphi_i$ is therefore given purely by way of the axial position of the cylinders on the crankshaft.

FIG. 3 is a graph similar to FIG. 2 showing the angle deviation $\Delta\varphi_8$ for the cylinder Z8 of the eight-cylinder engine shown in FIG. 1, but with different firing spacings. The firing order was retained with Z1→Z6→Z3→Z5→Z4→Z7→Z2→Z8, but the firing spacings expressed in crank angle are 120°, 60°, 120°, 60°, 120°, 60°, 120° etc. Therefore, as described with reference to FIG. 2, there are again 180° crank angles between the firing events of the cylinders Z1, Z3, Z4 and Z2, but only 60° between the firing events between cylinders Z6→Z3, Z4→Z7 and Z8→Z1. The altered firing spacings influence the pattern of the angle deviation, which is here plotted for the crankshaft position at cylinder Z8. Again, firing of the cylinder Z1 at the 0° crankshaft angle has no influence worth mentioning on twist of the crankshaft at the position of the cylinder Z8. The contributions to twist occur proportionally to the firing spacings, for a firing spacing of 120° provides that a torsional fluctuation introduced can be propagated longer than is the case with a firing spacing of 60°.

While in the example of the firing spacings in FIG. 2 where all cylinders are fired at equal firing spacings and thus the resulting torsional fluctuation respectively has the same time for propagation, the example of the firing spacings 120°/160° in FIG. 3 affords a different picture in respect of angle deviation. The contributions to the torsional fluctuation of those cylinders which are fired at the 120° firing spacing therefore occur as 2:1 in relation to those cylinders which are fired at the 60° firing spacing, therefore the ratio of the contributions, expressed as the weighting factor, occurs at 2/3 to 1/3.

The weighting factor therefore takes account of how much later the next application of force occurs.

Once again the resulting pattern in respect of angle deviation $\Delta\varphi_i$ can now be transferred to any desired axial position of the crankshaft as, as a boundary condition, it is again established that no twist occurs at cylinder Z1 at the drive output side.

In accordance with the method it is therefore possible, without measurement and merely from knowledge of the firing spacings and the firing order, as well as the distance of the cylinders relative to each other, to determine the magnitude of the angle deviation caused by torsion or torsional fluctuation, in crankshaft angle-resolved relationship, for each cylinder. The invention therefore makes use of the realisation that a standing wave in respect of torsion or torsional fluctuation is implemented over a period of 720° crankshaft angle.

By virtue of the weighting factor the method takes account of whether the firing order is harmonic (equal firing spacing over all cylinders) or whether the firing spacings occur at spacings of unequal size, expressed as a crank angle. The crank angle which is between two firing events is synonymous with the time that the fluctuation has to develop. Interpreted as waves a uniform firing spacing means that all firing events occur in phases, while with unequal firing spacings there are a plurality of waves (two waves in the case of two different firing spacings) which are in a shifted phase position relative to each other.

Engine diagnostics can be particularly advantageously implemented with the method according to the invention as sensor signals can now always be associated with the correct crankshaft position. For example sensor signals of a cylinder pressure monitoring system can be corrected in relation to the torsional angle deviation. To sum up, a higher quality in terms of control over combustion and thereby a higher level of efficiency and higher power density can be achieved. The method is particularly advantageous due to the improved accuracy in firing times and measurements in the cylinder like for example cylinder pressure detection.

The invention claimed is:

1. A method of controlling an internal combustion engine, comprising:

providing the internal combustion engine connected at a fixed drive output side of a crankshaft to a generator;

connecting a plurality of cylinders to the crankshaft of the internal combustion engine via a plurality of connecting rods;

measuring with a measuring device torsion deviations for each crank angle of a working cycle occurring between a twisted and an untwisted condition of the crankshaft to obtain measured angle deviations for each cylinder position along a longitudinal axis of the crankshaft;

calculating in real time for each cylinder of at least two cylinders of the plurality of cylinders, a cylinder-individual and crank angle-resolved value of angle deviation for the respective cylinder based on a geometric spacing, a firing spacing, and the measured angle deviations effected instantaneously in the current engine cycle, wherein the geometrical spacing of each cylinder of the at least two cylinders of the plurality of cylinders comprises an axial distance along the longitudinal axis from the fixed drive output side of the crankshaft to the respective cylinder, wherein the fixed drive output side is assumed to be fixedly clamped, wherein the firing spacing of each cylinder of the at least two cylinders of the plurality of cylinders comprises an angular difference between successive firing events in cylinders of the plurality of cylinders; and correcting actuation of actuators of the internal combustion engine based on the cylinder-individual and crank angle-resolved value and transmitting signals from a sensor in the internal combustion engine based on the cylinder-individual and crank angle-resolved value to control the internal combustion engine.

2. The method as set forth in claim 1, wherein a curve representing a magnitude of the angle deviation oscillates with varying peaks relative to the crank angle over the working cycle, wherein the varying peaks generally align with the firing spacing, and the magnitude of the angle deviation varies at least partially based on the geometrical spacing.

3. The method as set forth in claim 1, wherein calculating the cylinder-individual and crank angle-resolved value is in dependence on operating conditions.

4. The method as set forth in claim 3, wherein calculating the cylinder-individual and crank angle-resolved value is by a model function.

5. The method as set forth in claim 1, wherein the cylinder-individual and crank angle-resolved values of angle deviation for the at least two cylinders of the plurality of cylinders is different based on different axial distances along the longitudinal axis from the fixed drive output side of the crankshaft to the at least two cylinders.

6. The method as set forth in claim 1, wherein the cylinder-individual and crank angle-resolved value of angle deviation is different for different angular differences between successive firing events in cylinders of the plurality of cylinders.

7. The method as set forth in claim 1, wherein calculating the cylinder-individual and crank angle-resolved value varies based on whether the firing spacing is a uniform or a non-uniform angular difference between the successive firing events in cylinders of the plurality of cylinders.

8. The method as set forth in claim 1, wherein at least one engine management parameter is adjusted based on at least one cylinder-individual and crank angle-resolved value.

9. The method as set forth in claim 1, wherein at least one engine measurement is adjusted based on at least one cylinder-individual and crank angle-resolved value.

10. The method as set forth in claim 9, wherein the adjusted engine measurement is a cylinder pressure measurement.

11. A stationary internal combustion engine operable according to the method as set forth in claim 1.

12. A method, comprising:

calculating a cylinder-individual and crank angle-resolved value of angle deviation of a crankshaft of an internal combustion engine due to torsion of the crankshaft for each crank angle during a working cycle, wherein calculating the cylinder-individual and crank angle-resolved value of the angle deviation compensates at least for a geometric spacing and a firing spacing for each cylinder of a plurality of cylinders of the internal combustion engine, wherein the geometrical spacing of each cylinder of the plurality of cylinders comprises an axial distance along a longitudinal axis from a fixed drive output side of the crankshaft to the respective cylinder, wherein the fixed drive output side is assumed to be fixedly clamped, and wherein the firing spacing of each cylinder of the plurality of cylinders comprises an angular difference between successive firing events in the plurality of cylinders; and adjusting sensor feedback and/or control of the internal combustion engine based on the cylinder-individual and crank angle-resolved value.

13. The method as set forth in claim 12, wherein a curve representing a magnitude of the angle deviation oscillates with varying peaks relative to the crank angle over the working cycle, wherein the varying peaks generally align with the firing spacing, and the magnitude of the angle deviation varies at least partially based on the geometrical spacing.

* * * * *